US006435742B1

(12) United States Patent
Natalis

(10) Patent No.: US 6,435,742 B1
(45) Date of Patent: Aug. 20, 2002

(54) APPARATUS FOR IMPACT MARKING

(75) Inventor: Giovanni Natalis, Cesano Maderno (IT)

(73) Assignee: Sitel, S.P.A., Milan (IT)

( * ) Notice: Subject to any disclaimer, the term of this patent is extended or adjusted under 35 U.S.C. 154(b) by 0 days.

(21) Appl. No.: 09/383,646

(22) Filed: Aug. 26, 1999

(51) Int. Cl.[7] ..... B41J 2/22
(52) U.S. Cl. ..... 400/124.01; 400/118
(58) Field of Search ..... 400/124.01, 118, 400/127, 128, 130, 124.05, 124.11, 124.21

(56) References Cited

U.S. PATENT DOCUMENTS 4,506,999 A 3/1985 Robertson
4,591,279 A 5/1986 Speicher
4,808,018 A 2/1989 Robertson et al.
5,002,411 A * 3/1991 Therond ..... 400/118
5,316,397 A * 5/1994 Robertson et al. ..... 400/121
5,501,535 A * 3/1996 Hastings et al. ..... 400/88
5,568,392 A * 10/1996 Flickner et al. ..... 364/478.15
6,135,022 A * 10/2000 Troester ..... 101/18

FOREIGN PATENT DOCUMENTS

FR 2 256 833 8/1975

* cited by examiner

*Primary Examiner*—Daniel J. Colilla
*Assistant Examiner*—Darius N. Cone
(74) *Attorney, Agent, or Firm*—Robert F. I. Conte; Lee, Mann, Smith, McWilliams, Sweeney & Ohlson

(57) ABSTRACT

An apparatus for impact marking comprises a marking unit (2) able to be gripped manually, an electronic control unit (3) mounted directly on the marking unit (2) and a power supply unit (4) situated in a transportable auxiliary containment structure **(4*a*) and connected to the marking unit by means of an extensible cable (25) and an extensible hose (26). The marking unit (2) presents elements (7) for bearing onto a piece to be marked, and a punch (15) movable on two axes by means of motors (10, 13) controlled by the electronic control unit (3). The punch (15) can be actuated with vibratory motion by means of a solenoid valve (21) controlled by the electronic control unit (3), mounted directly on the punch head (14)**.

13 Claims, 4 Drawing Sheets

APPARATUS FOR IMPACT MARKING

FIELD AND BACKGROUND OF THE INVENTION

The present invention relates to an apparatus for impact marking of the type comprising a power supply unit; a marking unit; a programmable electronic control unit to manage the actuation of the marking unit.

As is well known, several sectors of the industry require produced or assembled pieces to be adequately marked, i.e. provided with markings indicating, for instance, the manufacturing company, the production lot or relating to other kinds of information.

One of the marking methods employable, whereto the present invention is aimed, consists of composing the desired captions or signs by means of a sequence of points produced by the impact of a punch onto the surface of the piece being processed.

For this purpose, apparatuses are used wherein the aforementioned punch is integrated in a marking unit supported in an offset position above a platform whereon the piece can bear and housing the means for activating the punch, as well as the motors and transmission and guidance organs necessary to allow moving the punch on the surface of the piece.

The operation of the marking unit is managed by an electronic control unit connected via cable to the marking unit itself and able to interface, also through a connecting cable, to a personal computer for programming the marking operation to be performed.

The entire apparatus is powered electrically through a direct connection to the external electrical power grid, as well as pneumatically, by means of a connection of the marking unit to a compressor or to a pneumatic distribution line pre-installed in the plant.

The apparatuses of the kind described above currently have fixed installation, and the pieces to be marked are from time to time positioned on the bearing base below the marking unit.

In numerous applications, however, it would be preferable to have available an easily transportable apparatus, able to be gripped manually in order to be carried directly on the piece undergoing the work process.

To meet such requirements, the applicant has already proposed an embodiment wherein to the marking units are associated grip handles to allow them to be gripped manually, as well as elements for bearing on the piece undergoing the work process to maintain the punch at a suitable distance from its surface. These apparatuses, derived essentially from an adaptation of the fixed position apparatuses, nonetheless present rather limited ease of handling and can be improved in several aspects.

SUMMARY OF THE INVENTION

In accordance to the present invention the applicant has observed that for the purposes of the ease of operation of the apparatus, it is advantageous to ready the electronic control unit, with the possible keyboard for its programming, directly associated on the marking unit, as defined in claim 1.

In this way, the need to provide a support seat for the electronic control unit, as well as the cables connecting it to the marking unit.

The control unit can advantageously be made removable from the marking unit, as expressed in claim 3 to allow it to operate remotely from the marking unit itself.

For the purposes of the invention it is also advantageous to provide the apparatus, and in particular the marking unit destined to be handled manually, with an extremely compact and light structure, without thereby compromising its performance, particularly with reference to the amplitude of the working area involved by the operation of the punch.

In accordance with a further aspect of the invention, which can find application even independently of the presence of the electronic control unit mounted directly on the marking unit, for this purpose the punch is driven by a first motor mounted on the support frame of the marking unit, and by a second motor fixed with respect to a first cursor moved by a first motor as defined in the characterising part of claim 12.

The applicant has further found it advantageous to reduce, as far as possible, the electrical and/or pneumatic consumption of the entire apparatus so that the latter can be used in combination with a small and easily transportable autonomous power supply unit. For this purpose, in accordance with a further inventive aspect which is applicable independently from what is stated above, the operation of the punch is managed through a solenoid valve mounted in immediate proximity to the punch itself as defined in claim 4.

BRIEF DESCRIPTION OF THE DRAWINGS

Further features and advantages of the invention shall be made more readily apparent from the detailed description that follows of a preferred, but not exclusive, embodiment of an apparatus for impact marking, according to the present invention. The description shall be made here below with reference to the accompanying drawings, provided purely by way of non limiting example, wherein.

DESCRIPTION OF THE PREFERRED EMBODIMENT

Figure 1:
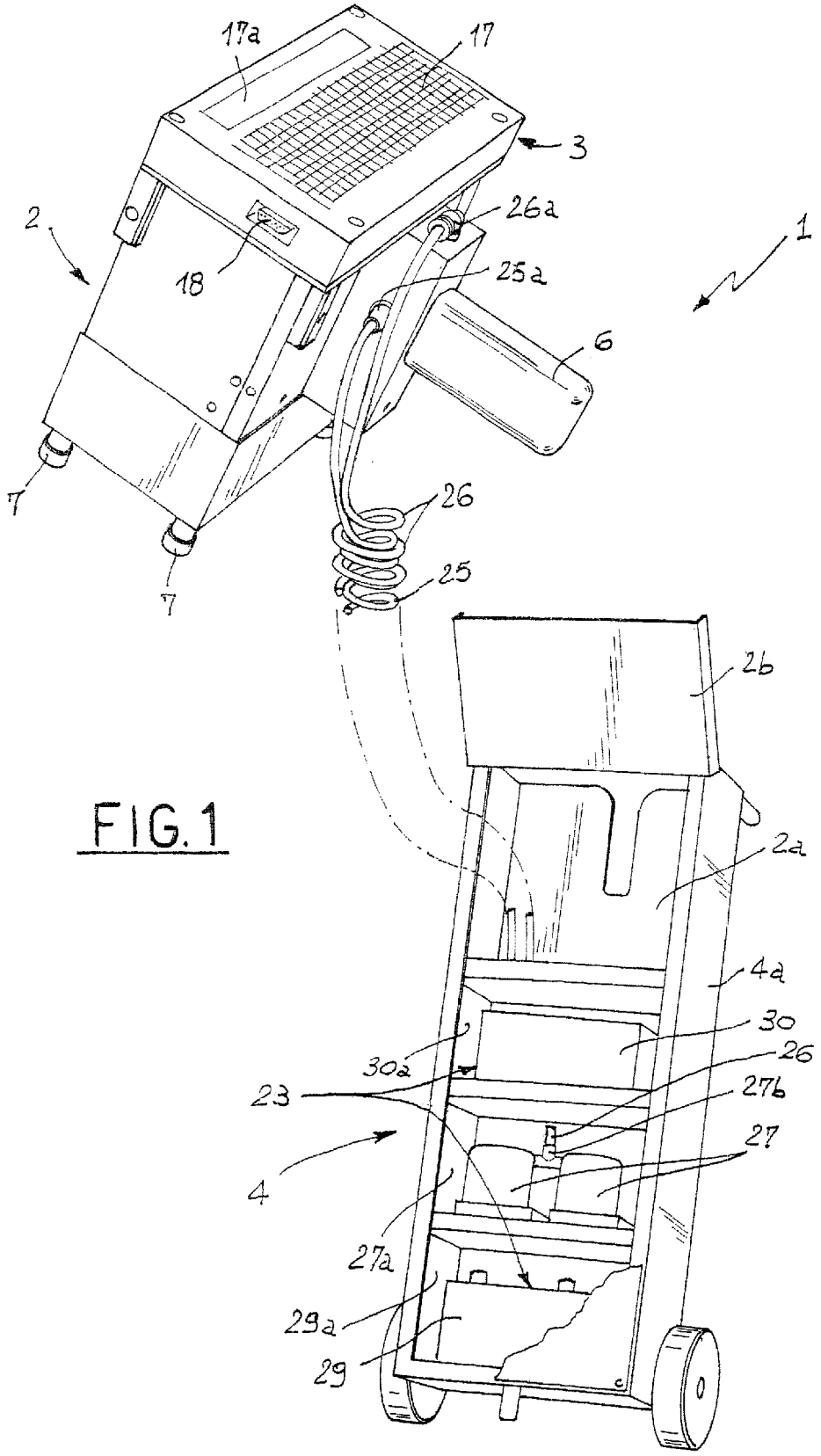
FIG. 1 shows in perspective view the apparatus according to the invention, with the marking unit removed from a respective housing set in a carriage bearing the power supply unit.
Figure 2:
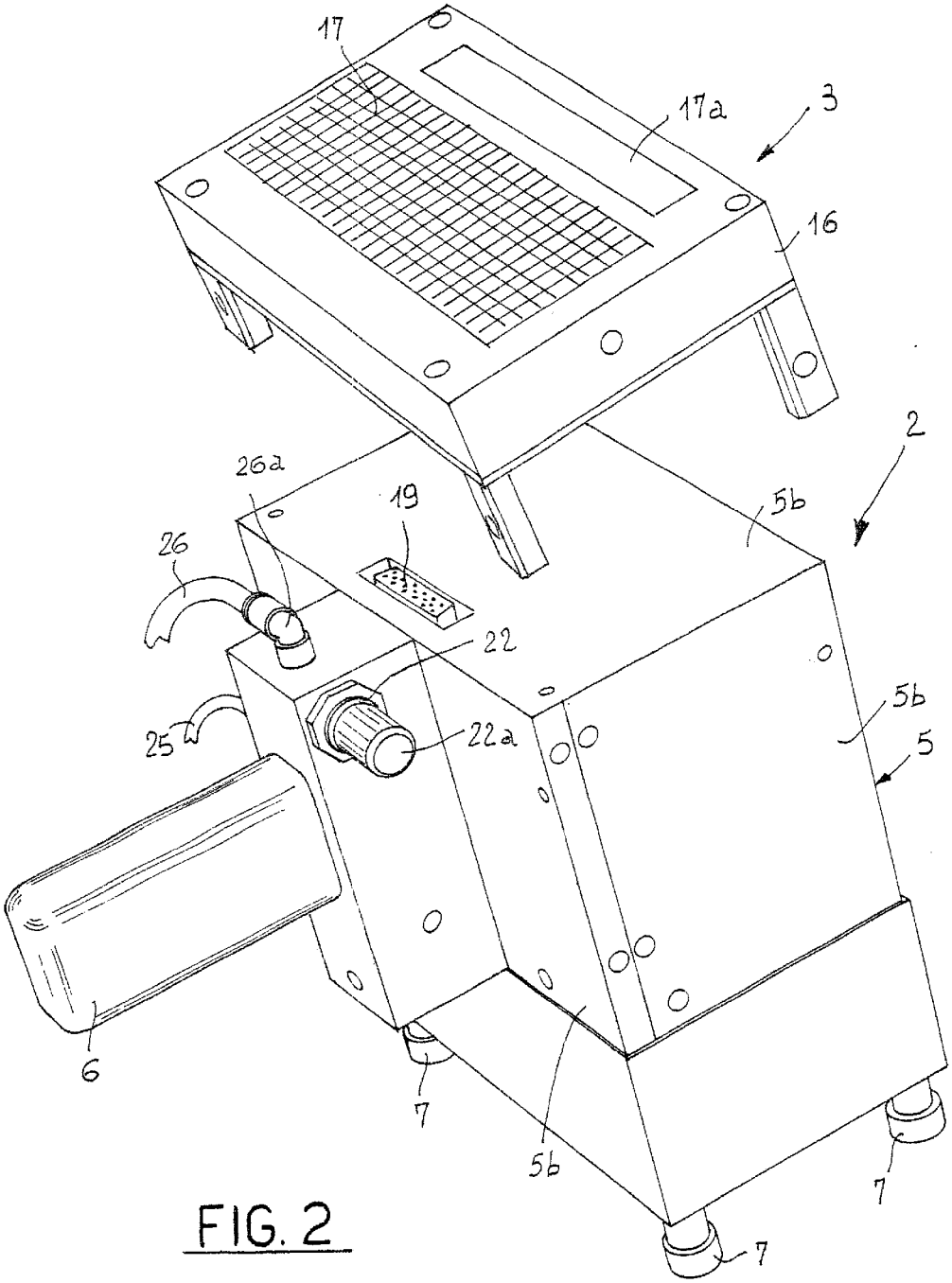
FIG. 2 shows in perspective view the marking unit and the electronic control unit shown in exploded view with respect to the marking unit itself.

With reference to the aforementioned figures, the number 1 indicates in its entirety an apparatus for impact marking according to the present invention.

The apparatus 1 essentially comprises a marking unit 2, an electronic control unit 3 to manage the operation of the marking unit 2, and a power supply unit 4 slaved to the marking unit 2 and to the electronic control unit The marking unit 2 presents a support and containment structure 5 comprising a frame 5*a* and covering panels 5*b*, and carrying at least a manual grip handle 6 and elements 7 bearing on a surface of a piece undergoing work operations.

Figures 4, 5:
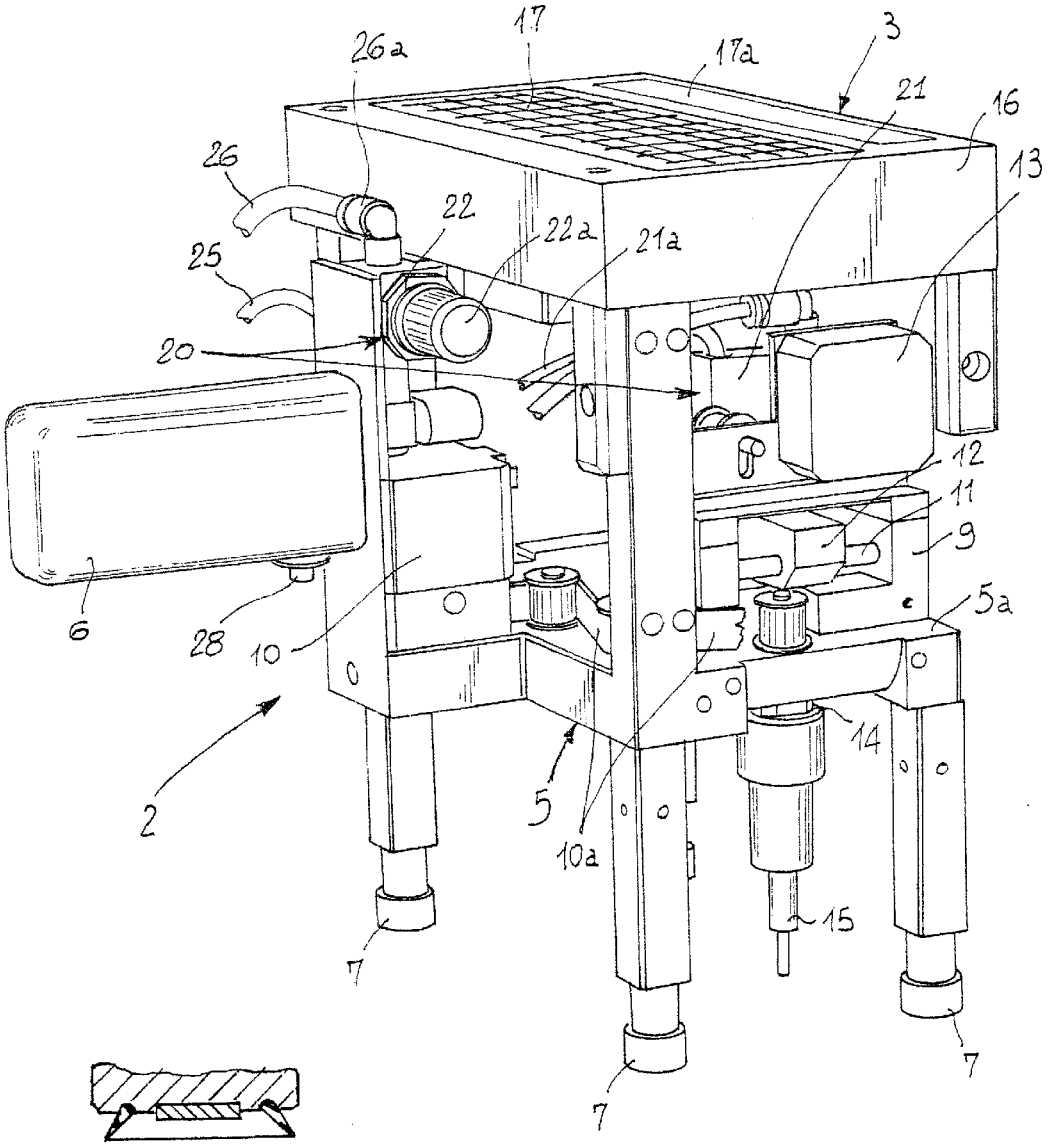
FIG. 4 is a perspective view similar to FIG. 3, taken from a different angle.
FIG. 5 shows an enlarged section of one of the bearing elements associated to the marking unit.

As shown in FIG. 5, each bearing element 7 can advantageously comprise a base body 7*a* engaged by screwing to a bar-shaped support 7*b* able to fastened to the frame 5*a*. The base body 7*a* comprises at least an elastomeric element 7*b* with anti-skid function set to act by bearing against the surface of the piece, combined with at least one permanent magnet 7*c* which assures the positioning stability on the piece itself when the latter is made of magnetic material. The elastomeric element 7*b* can be made in the form of a suction cup, thereby assuring stability also on pieces made of amagnetic material.

In the support and containment structure 5 are rigidly engaged first bars or equivalent guiding organs 8 whereon is slidingly engaged a first movable cursor 9 for commanding a first motor 10 through a first positive drive belt 10*a* (only partially shown). The first cursor 9 rigidly bears second bars or equivalent guiding organs 11 oriented perpendicularly with respect to first guiding organs 8 and slidingly engaging a second cursor 12.

The second cursor 12 is able to translate along second guiding organs 11 perpendicularly to the motion of the first cursor 8, through a second positive drive belt 13*a*whereon a second motor 13 fastened to the first cursor itself acts.

To the second cursor 12 is fastened a punch head 14, operatively bearing a punch 15 oriented in substantially perpendicular direction with respect to the directions of motion of the first and of the second cursor 8, 12. In a way wholly known in itself and thus not described in detail, the punch 15 can be actuated with vibratory motion in the longitudinal direction, so as repetitively to exert impact actions against the surface of the piece undergoing work whereon the bearing elements 7 act.

The position of the second motor 13, directly on the first cursor 9, is advantageous for the purposes of containing the size of the marking unit 2.

Figure 3:
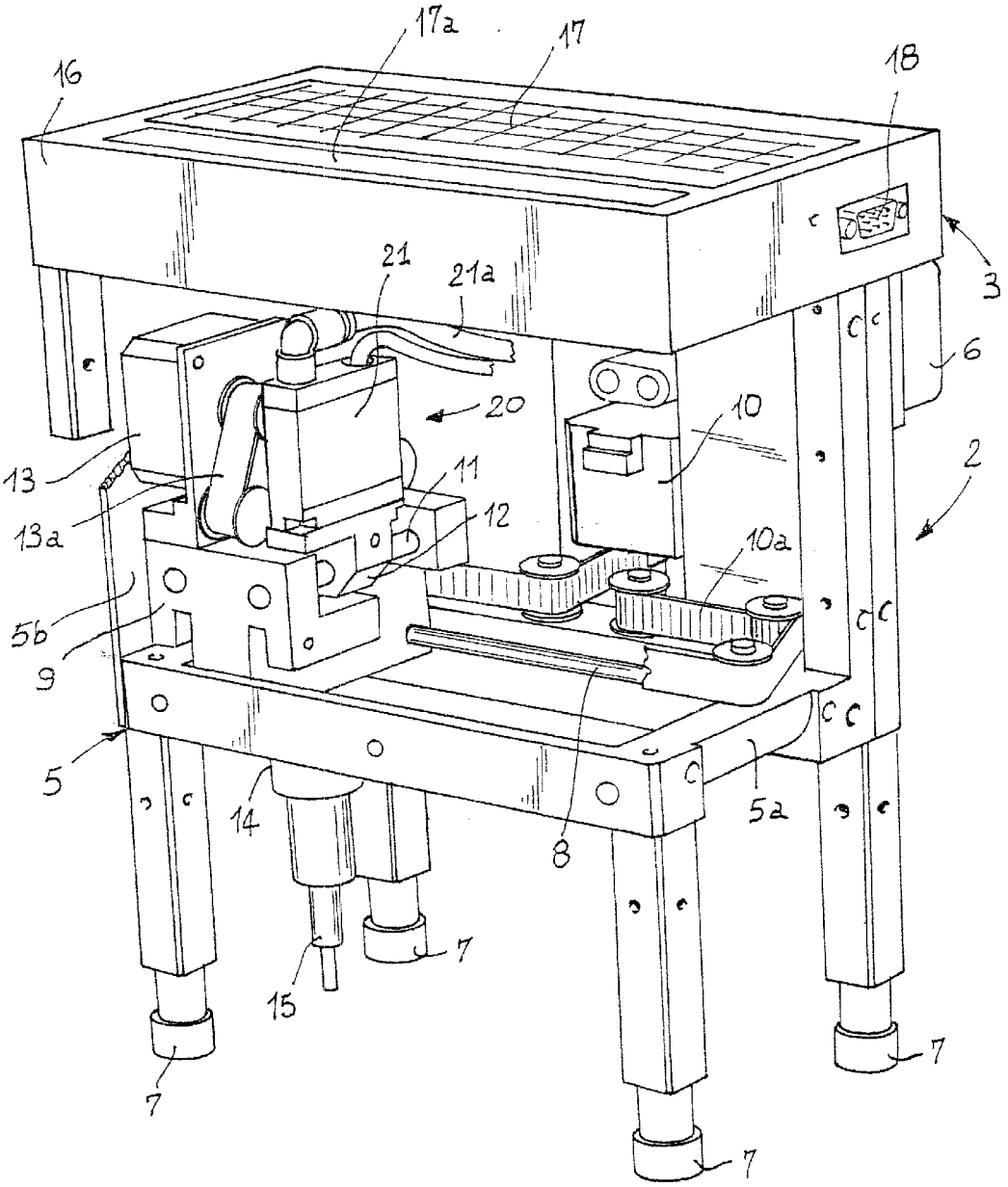
FIG. 3 shows in perspective view the marking unit, without the outer case the better to highlight its inner components.

As the accompanying figures show, the second motor 13 is contained in the support and containment structure 5, of essentially prismatic shape, without ever protruding therefrom, not even when the first cursor 9 is brought to its end of stroke position, flush with the lateral covering panel 5*b* (see FIG. 3).

The presence of the second motor 13 on the first cursor 9 entails a slight increase in the dimensions and consumption of the first motor 8, forced to move the additional mass represented by the second motor itself.

However, the dimensions and mass of the second motor 13 are very small as it has to drive esclusively the second cursor 12 and the few organs supported thereby, and the consequent dimensional increase of the first motor 9 is amply balanced by the advantageous reduction in the overall size of the support and containment structure 5, for the same working area according to which the punch 15 can be moved.

It should also be noted that the first motor 10 projects with respect to the support and containment structure 5 in correspondence with the side thereof that bears the grip 6, which can be advantageously so shaped as to house at least partially the first motor itself.

In other words in this way the support and containment structure can advantageously be inscribed in a prismatic solid with base side substantially coinciding with the working area of the punch 15 or only slightly superior thereto without the second motor 13 ever being subject to projecting with respect to such prismatic solid.

Also in accordance with the present invention the electronic control unit 3 able to control the operation of the marking unit 2 is directly fastened on the marking unit itself. More specifically the electronic control unit 3, not described among the electronic components as it can be realised in any advantageous manner by the person versed in the art, is preferably enclosed in a containment case 16 on one of whose sides a keyboard 17 can advantageously be integrated, equipped with liquid crystal display 17*a* to allow programming. Programming can take place also through a remote PC or through a memory unit able to interface with the electronic unit 3 by means of at least a lateral connector 18.

Preferably, moreover, the electronic unit 3 is removably engaged to the marking unit 2 and operatively connectable thereto through a multi-pole connector 19 connected through a wall of the marking unit itself opposite to the punch 15.

The multi-pole connector 19 can be exploited, if need be, to connect the electronic control unit 3 itself or a different control unit to the marking unit 2 remotely, with the aid of a suitable cable.

In the described embodiment, the actuation of the punch 15 with alternating motion is obtained by pneumatic actuation means 20 associated to the marking unit 2.

These pneumatic actuation means 20 essentially comprise a solenoid valve 21 fed with compressed air or other pressurised operating fluid in the manner that will become more readily apparent below, and electrically controlled by the electronic control unit 3 in such a way as to provide open phases alternating with closed phases.

In a way known in itself, the operating frequency of the valve, i.e. of the succession of the closure and opening phases, as well as the duration of the opening phases with respect to the closure phases, can be modulated according to needs by means of the electronic control unit 3.

In the open phase of the solenoid valve 21, compressed air is fed into a pressurisation chamber defined in the punch head 14 causing the advance of the punch 15 against the surface of the piece being worked on. In the closed phase, the pressurisation chamber is connected with the external environment thereby releasing the pressurised air and allowing the return of the punch 15 by effect of a return spring, assisted by a bounce-back effect of the punch itself against the surface of the piece being worked on.

The solenoid valve 21, advantageously mounted directly on the punch head 14 and/or on the second cursor 12 integral therewith, is subjected to the same movements imposed thereon for the purposes of moving the punch 15 on the surface of the piece.

The need is thereby eliminated to provide flexible hoses for the connection of the solenoid valve with the punch head 14, guaranteeing a greater operating efficiency of the punch head itself, and a drastic reduction in compressed air consumption thanks to the elimination of the "plenum" effect caused by the aforesaid connecting hoses used in the prior art.

The pneumatic actuation means 20 can further comprise at least one pressure regulating valve 22 operatively positioned upstream of the solenoid valve 21 and connected thereto by means of a flexible conduit 21*a*. The pressure regulating valve 22 can present an adjustment knob 22*a* projecting externally in proximity to the grip 6 to allow the user to adjust the pressure of the compressed air supply according to requirements.

Along the flexible connecting conduit 21*a*, and in any case between the pressure regulating valve 22 and the solenoid valve 21, a pressure sensor (not shown) can be operatively provided, interfaced with the electronic control unit 3 to indicate thereto the pressure value set by means of the adjustment valve itself. The electronic unit 3 can advantageously display the measured value on the display 17*a*, and/or disable the operation of the marking unit when the measured pressure value is outside a pre-set range of values, previously stored and/or computed by the electronic control unit 3 based on other operating parameters set by the user, such as the operating frequency of the solenoid valve 21 and/or the ratio between the duration of the open and closed phases.

In the embodiment shown, the power supply unit 4 essentially comprises an electrical power supply set 23 connected to the marking unit 2 and the electronic control unit 3, as well as a pneumatic supply set 24 operatively connected with the pneumatic actuation means 20 associated with the marking unit 2. The electrical power supply set 23 and the pneumatic supply set 24, connected to the marking unit 2 by means at least of a cable 25 and a hose 26, both extensible, are preferably mounted in an auxiliary containment structure 4*a* preferably constructed in the manner of a carriage and ready to house the marking unit 2. in an upper compartment 2*a* which can be closed by a door 2*b*.

Alternatively, the extensible cable 25 can be connected to an electrical power supply unit, in turn connected to an electrical distribution grid pre-installed in the plant wherein the apparatus 1 is used, and the extensible hose 26 to a compressed air distribution line, also pre-installed.

The extensible hose 26 is connected to the pneumatic activation means 20 through a pneumatic union fitting 26*a* projecting from the grip 6 of the marking unit 2.

The extensible cable 25 is in turn connected to the marking unit 2 by means of a grip fitting 25*a* also positioned in proximity to the grip 6, to supply electrical power to the electronic components necessary to power the motors 10, 13 and the solenoid valve 21, such components being preferably installed inside the support and containment structure 5 and interfaced to the electronic control unit 3 through the multi-polar connector 19.

Electrical power to the electronic control unit 3 is instead transmitted by the marking unit 2, through the multi-polar connector 19 described above.

The extensible cable 25 and hose 26 advantageously spiral one inside the other, i.e. so shaped as to define respectively a first and a second spiral coaxially situated one inside the other, thereby allowing the marking unit 2 to be moved freely without risking entanglements of the flexible cable and hose 25, 26.

Thanks to the reduced consumption of the solenoid valve 21, the pneumatic supply set 24 can simply comprise at least a pneumatic pump 27 (two in the embodiment shown herein) housed in a compartment 27*a* provided in the auxiliary containment structure 4*a*.

Advantageously the pneumatic pump 27, able to be activated simultaneously with the marking unit 2 upon the command of a starting pushbutton 28 associated to the grip 6 or through a remote command, is directly connected to the extensible hose 26 with no need to interpose therebetween any compressed air accumulation plenum to guarantee the supply to the pneumatic supplying means 20 during the initial moments of marking. For this purpose, between the pneumatic pump 27 and the extensible hose 26, can be provided at least a unidirectional valve 27*b* that maintains the air under pressure in the hose itself during the idle phases of the marking unit 2.

The electrical power supply unit 23 in turn comprises at least a battery 29 housed in a respective compartment 29*a* obtained in the auxiliary containment structure 4*a* and set to feed the pneumatic supply set 24, the marking unit 2 and the electronic control unit 3. In a further compartment 30*a* provided in the auxiliary containment structure 4*a* can also be housed an electrical power supply unit connectable with an external electrical power supply line to recharge the battery 29 and/or electrically power the pneumatic supply set 24, the marking unit 2 and the electronic control unit 3.

The use of the apparatus 1 is extremely simple and practical. The apparatus 1 is suitable to be easily transported to the location where the marking is to be performed and the marking unit 2 is able to be picked up manually from the auxiliary containment structure 4*a* to be brought with the bearing elements 7 against the surface of the piece to be marked.

The text to be impressed on the surface of the piece can be set directly by the operator by means of the keyboard 17 provided on the marking unit 2 or stored in the electronic control unit 3 through the lateral connector 18.

Once the marking unit 2 is positioned against the surface of the pieces the starting pushbutton 28 is pressed to activate the punch 15 which, suitably driven by the first and by the second. motor 10, 13, possibly with successive steps in synchrony with the opening and closing phase of the solenoid valve 21, impresses on the surface of the piece a series of aligned points to define the previously memorised writing characters and/or drawings.

The present invention thereby attains the proposed aims.

It should be noted that the arrangement whereby the electronic control unit is directly installed on the marking unit, though seemingly disadvantageous from the standpoint of weight containment and of the ease of handling of the marking unit itself, is found to be unexpectedly advantageous for purposes of the ease of use of the apparatus as a whole.

For example, the operator has the advantage of being able to modify the text to be impressed on the marked piece on each occasion without having to store the marking unit, and the slight increase in weight and size brought about by the electronic control unit on the marking unit is amply balanced by the elimination of the connecting cable which it would otherwise be necessary to interpose between the marking unit and the electronic unit itself if the latter were positioned separately from the marking unit.

The constructive expedients adopted in the realisation of the marking unit have further allowed to confer thereto a considerable reduction in weight and size for the same working area of the punch. In this regard it should be noted that the expedients proposed by the invention allow to reduce the weight of the marking unit, complete with electronic control unit, down to no more than three kilograms, maintaining a punch working area equal to about 110×30 mm.

The invention has further allowed a noticeable limitation of compressed air consumption by the marking unit, and this has enabled considerably to reduce weight and size of the entire power supply unit, both in relation to the pneumatic supply and in relation to the electrical power supply set also slaved to the pneumatic supply set.

It should also be observed that if need be it is possible to install a punch head with electromagnetic operation allowing a further reduction in the dimensions and bulk of the power supply unit.

Naturally, the invention thus conceived can be subject to numerous modifications and variations, without thereby departing from the scope of the inventive concept that characterises it.

What is claimed is:

1. Apparatus for impact marking, comprising: a power supply unit;

a marking unit, including a support and containment structure bearing at least a manual gripping handle and elements for bearing on a surface of a piece undergoing work; a first cursor engaged to first guiding organs integral with respect to the support and containment structure and movable on command of a first motor; a second cursor engaged on second guiding organs integral with respect to the first cursor and movable on command of a second motor in a direction substantially perpendicular to the direction of motion of the first cursor; a punch head fastened to the second cursor and bearing a punch able to be actuated with vibratory motion directed towards the surface of the piece undergoing work repetitively to exert impact actions against it;

a programmable electronic control unit to menage the actuation of the marking unit, said electronic control unit being fastened directly on said marking unit;

wherein said first motor is mounted on the support frame, whereas the second motor is fixed with respect to the first cursor.

2. Apparatus as claimed in claim 1, wherein said electronic control unit is enclosed in a box container on one of whose sides is integrated a keyboard for programming the electronic unit itself.

3. Apparatus as claimed in claim 1, wherein said electronic control unit is removably engaged to the marking unit and operatively connectable thereto through a multi-polar connector.

4. Apparatus for impact marking, as claimed in claim 1, in which said power supply unit comprises an electrical power supply set and a pneumatic supply set operatively connected with pneumatic actuation means associated to the marking unit, said pneumatic actuation means comprising at least a solenoid valve managed by said electronic control unit to actuate the punch with alternating motion, wherein said solenoid valve is fixed with respect to the second cursor and to said punch head.

5. Apparatus as claimed in claim 4, wherein said pneumatic actuation means further comprise at least a pressure regulating valve operatively positioned upstream of said solenoid valve to set the value of the supply pressure of an operative fluid to the valve itself.

6. Apparatus as claimed in claim 5, wherein to said electronic control unit is interfaced at least a pressure sensor operating between the pressure regulating valve and said solenoid valve, to disable the operation of the marking unit when the measured pressure value is outside a predetermined range of values.

7. Apparatus as claimed in claim 4, wherein said pneumatic supply set comprises at least a pneumatic pump able to be activated simultaneously with the activation of the punch head and operatively connected to the marking unit by means of at least a flexible hose engaging on the support frame, at least a unidirectional valve being interposed between said at least one pump and said flexible hose to retain operative fluid under pressure inside the hose itself when said pump is turned off.

8. Apparatus for impact marking, as claimed in claim 4, wherein said electrical power supply set and said pneumatic supply set are mounted in an auxiliary containment structure and interconnected to the marking unit respectively by means of at least an extensible cable and an extensible hose.

9. Apparatus as claimed in claim 8, wherein said extensible cable and hose are so shaped as to define a first and a second spirals coaxially positioned one inside the other.

10. Apparatus as claimed in claim 4, wherein said electrical power supply set comprises at least a battery to power the pneumatic supply set, the electronic control unit and the marking unit.

11. Apparatus as claimed in claim 10, wherein in said auxiliary containment structure is further housed a power supply unit connectable to an external electrical power supply line to recharge at least a battery and/or electrically power the pneumatic supply set, the electronic control unit and the marking unit.

12. Apparatus as claimed in claim 11, wherein said first motor projects from the support and containment structure in correspondence with a side bearing said grip.

13. Apparatus for impact marking, as claimed in claim 12, wherein each of said bearing elements comprises a base body bearing at least an antiskid elastomeric element, preferably shaped in the manner of a suction cup, provided to act against the surface of the body, to said elastomeric element being combined at least a permanent magnet.

* * * * *